United States Patent [19]

Bosch

[11] 3,995,975

[45] Dec. 7, 1976

[54] GEAR PUMP

[75] Inventor: Paul Bosch, Ludwigsburg, Germany

[73] Assignee: Robert Bosch G.m.b.H., Stuttgart, Germany

[22] Filed: Mar. 18, 1975

[21] Appl. No.: 559,595

[30] Foreign Application Priority Data

Mar. 27, 1974 Germany ..... 2414760

[52] U.S. Cl. ..... 418/74; 418/126; 418/206

[51] Int. Cl.[2] ..... F04C 29/00

[58] Field of Search ..... 418/71, 74, 125, 126, 418/129, 206

[56] References Cited

UNITED STATES PATENTS

| | | | |
|---|---|---|---|
| 1,134,357 | 4/1915 | Silvestri | 418/129 |
| 1,783,209 | 12/1930 | Wilsey | 418/129 |
| 2,918,877 | 12/1959 | Woodcock | 418/71 |
| 3,472,170 | 10/1969 | Eckerle | 418/126 |
| 3,838,952 | 10/1974 | Futamata | 418/126 |

FOREIGN PATENTS OR APPLICATIONS

| | | | |
|---|---|---|---|
| 504,828 | 8/1954 | Canada | 418/74 |
| 1,374,351 | 8/1964 | France | 418/71 |
| 132,688 | 7/1929 | Switzerland | 418/74 |

*Primary Examiner*—C. J. Husar
*Attorney, Agent, or Firm*—Michael J. Striker

[57] ABSTRACT

A gear pump having a drive gear provided with trunions mounted for rotation in the housing of the pump and a driven gear meshing with the drive gear and guided in the housing only on side faces and a portion of the inner peripheral surface of the housing and pressed by fluid pressure against the driven gear. A first sealing member at the outlet of the housing presses the driven gear against a sealing zone of the housing adjacent the inlet thereof and a second sealing member subjected to fluid pressure presses the driven gear against the drive gear. A low pressure zone is arranged at the inner peripheral surface of the housing between the two sealing members, whereas a high pressure zone is arranged between the second sealing member and the sealing zone.

9 Claims, No Drawings

GEAR PUMP

BACKGROUND OF THE INVENTION

The present invention relates to a gear pump with two meshing gears, in which the trunions of the drive gear are mounted for rotation in the housing of the gear pump, eventually in special bearings, whereas the driven gear has no trunions, but is loosely mounted in the housing and pressed by fluid pressure in such a manner against the drive gear and the housing so that the gears will mesh with each other without play on the flanks of the gear teeth.

In known gear pumps of the aforementioned kind the portion of the housing engaged by the gear teeth extends only over a short part of the circumference of the gears, at the outlet side of the pump which is covered by two side plates. The driven gear is only pressed onto the inner surface of the housing and the drive gear by the fluid pressure acting thereon. Such a pump, in which the driven gear may be mounted in such unstable manner is suitable only for very small feed pressures. Such a pump is, however, completely unsuitable for greater outputs and pressures.

SUMMARY OF THE INVENTION:

It is an object of the present invention to provide for a gear pump of the aforementioned kind which is suitable for great outputs and great delivery pressures.

It is a further object of the present invention to provide for a gear pump of the aforementioned kind which is composed of relatively simple and few parts so that it can be manufactured at reasonable cost and will stand up properly under extended use.

With these and other objects in view, which will become apparent as the description proceeds, the gear pump according to the present invention mainly comprises a pair of meshing gears, only one of which is provided with axial trunions, a housing having an inlet and an outlet and defining between the inlet and the outlet a chamber having inner peripheral cylindrical surface portions respectively engaging outer surfaces of the teeth of said gears and opposite side faces in engagement with corresponding side faces of the gears. A pair of axially aligned bearing portions are provided in the housing respectively receiving the trunions of the one gear, with one of the trunions projecting beyond the housing for applying a torque to this gear. A first sealing member is arranged in the housing at the outlet thereof and subjected to fluid pressure in the outlet and this first sealing member engages at least the other of the pair of gears for pressing the latter against a sealing zone provided at the inner peripheral surface of the chamber opposite the first sealing member and bordering the inlet of the housing. A second sealing member is located in a cavity of the housing and subjected at its outer surface to fluid pressure for pressing with its inner surface the other gear against the one gear. A low pressure zone provided in the inner peripheral surface portion of the housing extends about the other gear between the first and second sealing member, whereas a high-pressure zone provided in the inner peripheral surface portion is located between the second sealing member and the sealing zone.

In this way forces are produced which will load the other, i.e., the driven gear, which does not have any bearing trunions, in such a manner so that the left as well as the right flanks of the teeth thereof will be tightly pressed against the corresponding flanks of the gear teeth of the drive gear and so that the driven gear will also seal the output side of the pump against the low pressure zone thereof. Such a pump can be manufactured at very reasonable cost and the friction forces and resulting wear in such a pump will be extremely low.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

Figure 1:
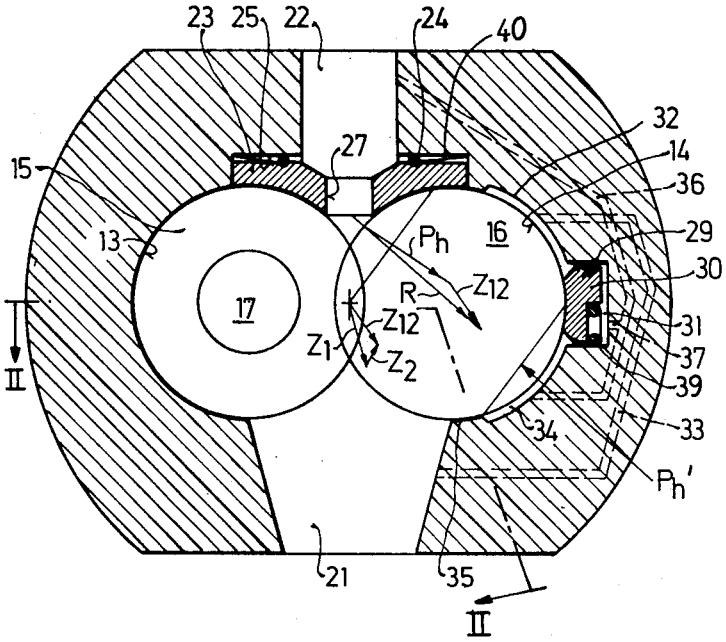
FIG. 1 is a cross-section through the gear pump taken in direction normal to the axes of the gears.
Figure 2:
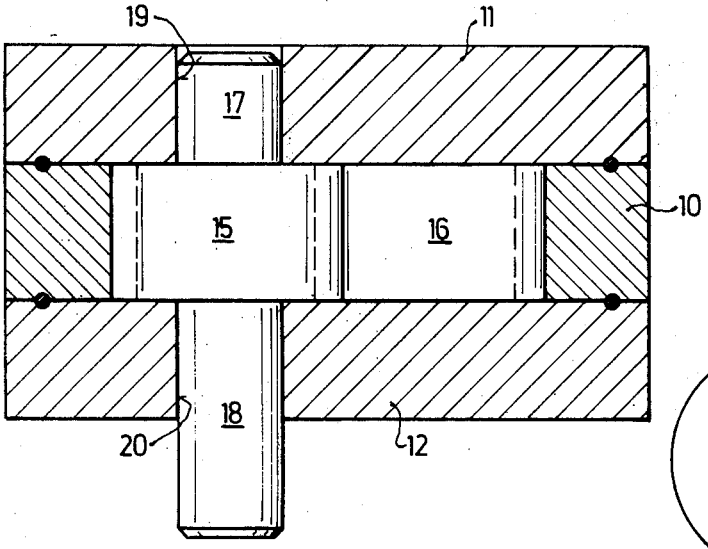
FIG. 2 is a cross-section taken along the line II—II of FIG. 1.
Figure 4:
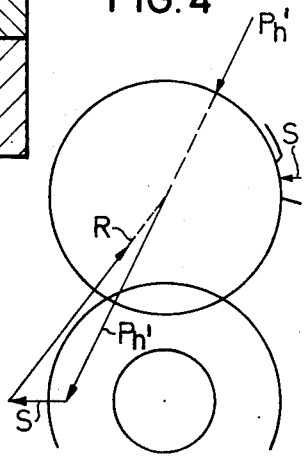
FIG. 4 schematically illustrates the forces acting on the driven gear.

DESCRIPTION OF THE PREFERRED EMBODIMENTS:

Referring now to the drawing, and more specifically to FIGS. 1 and 2, it will be seen that the gear pump according to the present invention comprises a housing having a central part 10 closed at opposite ends by covers 11 and 12. Two intersecting bores 13 and 14 forming together with the covers 11 and 12 a chamber having substantially the form of the number 8 are provided in the central part 10. Two gears 15 and 16 are arranged in the aforementioned chamber, the outer teeth of which mesh with each other. The gear 15 has axially projecting trunions 17 and 18 which are respectively turnably mounted in bores 19 and 20 of the covers 11 and 12. The trunion 18 projects beyond the cover 12 and serves to drive the gear pump, that is the gear 15 is in this arrangement the drive gear. The driven gear 16 is not provided with trunions but is loosely mounted in the bore 14 and can move slightly in radial direction.

The housing is provided with a further bore 21 which communicates at the inner end with the chamber formed by the bores 13 and 14 and which at its outer end is connected by a conduit, not shown in the drawing, to a source of fluid. The bore 21 is therefore the inlet or the suction side of the pump. The housing is further provided, coaxial with the bore 21 and opposite thereof, with a bore 22 communicating at the inner end thereof with the chamber provided in the housing and connected by a non-illustrated conduit with a consumer. The bore 22 therefore constitutes the outlet or pressure side of the pump. A sealing member 23 is provided in a cavity 25 formed in the part 10 of the housing at the inner end of the outlet bore 22, and the inner face of the sealing member 23 is constructed to match the outer diameters of the two gears. The sealing member 23 extends over less than a quarter of the circumference of each gear from the pressure side of the pump toward the suction side thereof. The sealing member 23 is located in the cavity 25 with radial and tangential play and an annular seal 24 of a diameter slightly greater than that of the bore 22 is provided at the inner end of this bore between the slightly spaced surfaces of the sealing member 23 and the corresponding surface of the housing defining the cavity 25. The sealing member 23 is provided with a bore 27 coaxially with and communicating with the inner end of the bore 22. The width of the sealing member 23 as considered in axial direction of the gears corresponds to the width of the gears. The sealing member 23 is pressed by the fluid pressure in the outlet 22 and eventually also by a spring 40 tightly against the outer faces of the gear teeth.

In order not to prevent small movements of the gear 16 toward and away from the gear 15 resulting from inaccuracies of the gear teeth, the engaging surfaces between the sealing member 23 and the gears 15 and 16 are chosen relatively small.

A further cavity 29 is formed in the inner surface of the housing defined by the bore 14 substantially symmetrically arranged with respect to a plane including the axes of the two gears, and an additional sealing member 30 is arranged in the cavity 29. The sealing member 30 has a substantially rectangular cross-section, and its surface facing the gear 16 corresponds to the outer diameter of this gear. The sealing member 30 is provided, on its surface opposite the one facing the gear 16, with a cavity 31 which forms a pressure space which is sealed by a seal 39 towards the outside. The dimension of the sealing member 30 in axial direction of the gears corresponds to the thickness of the latter.

A curved cavity 32 extends from the cavity 29 in which the sealing member 30 is arranged toward, but short of, the cavity 25 in which the sealing member 23 is located. The curved cavity 32 is connected, by a channel 33 formed in the housing, with the low pressure bore 21 and forms therefor a low pressure zone. The width of the cavity 32 as considered in axial direction of the gear, corresponds likewise substantially to the thickness of the gears.

A further curved cavity 34 extends from the cavity 29 toward, but short of, the bore 21 so that between the cavity 34 and the bore 21 a sealing zone 35 remains which extends up to the outer circumference of the gear 16. The width of the cavity 34 as measured in axial direction of the gears corresponds likewise to the thickness of the gear 16. The cavity 34 is connected by a channel 36 formed in the housing with the bore 22 and forms therefor a high pressure zone. A short passage or channel 37 branches off the channel 36 and communicates with the cavity 29 in the region of the pressure space 31. The driven gear 16 is mounted with radial play in the bore 14, that is the distance of the axis thereof from the axis of the gear 15 can change slightly during rotation of the gears due to inaccuracies of the flanks or in the pitch of the two gears.

During operation of the pump, the two gears will convey fluid from the bore 21 along the inner surfaces of the bores 13 and 14 to the bore 22 in which pressure will build up. The forces acting on the driven gear 16 are illustrated in FIG. 1, that is the force $Z_1$ which is the force acting on the driving flank, $Z_2$ the force imparted to the other flank and $Z_{12}$ is the resultant from the forces $Z_1$ and $Z_2$. The feed pressure and the sealing member 23 subjected to the feed pressure will act on the gear 16 with the force $P_h$. The resultant from the forces $P_h$ and $Z_{12}$ is shown at R. The sealing member 30 is pressed by fluid pressure against the gear 16. Since the cavity 34 is connected through the channel 36 to the fluid pressure at the outlet end of the pump, an additional hydraulic force will be imparted to the gear 16 which together with the force of the sealing member 30 will result in a force $P_h'$ likewise indicated in FIG. 1.

Disregarding the friction forces, the resulting force R will pass through the center of the gear 16. If the resultant R is in line and oppositely directed to the hydrostatic force $P_h'$, which always will be slightly greater than the force $P_h$, then a meshing of the gear 16 with the gear 15 without play will be assured and the loading of the radial guiding of the gear 16 will be held relatively small. The size of the force $P_h'$ is given by the size of the cavity 34 and the force produced by the sealing member 30.

Figure 3:
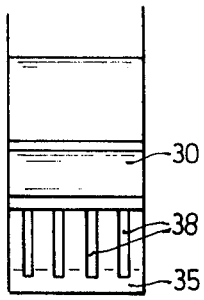
FIG. 3 illustrates a detail of a modification of the arrangement shown in FIG. 1.

It is however important that the gear 16 will abut also against the sealing zone 35 so that no fluid can pass from the delivery side of the pump and from the cavity 34 to the low pressure side of the pump, that is the bore 21. The necessary force S (see FIG. 3) is essentially produced by the sealing member 23. The force S will result when the pressure field in the cavity 34 is so arranged that the force $P_h'$ is turned slightly in counterclockwise direction from the position shown in FIG. 1, in the manner as shown in FIG. 3. The sealing member 30 will assure that even during slight change of the distance of the axes of the two gears from each other, which may occur due to inaccuracies in the teeth thereof, a perfect seal at the outer faces of the teeth of the gear 16 will be established. The magnitude of the force S can be varied by varying the angle between the forces R and $P_h'$, which in turn can be varied by changing the length of the cavity 34.

The engagement of the two gears without play will result in a considerable reduction of leakage losses and corresponding variations in the torque, and therefore the construction of the present invention may also advantageously be used for a gear-type fluid motor.

FIG. 3 shows a slight modification of the arrangement shown in FIG. 1 in which instead of the curved cavity 34 shown in FIG. 1 a plurality of parallel grooves 38 are provided which extend from the cavity 29 close to the sealing zone 35.

It will be understood that each of the elements described above, or two or more together, may also find a useful application in other types of gear pumps differing from the types described above.

While the invention has been illustrated and described as embodied in a gear pump in which only one of the gears is provided with bearing trunions, whereas the other gear is mounted in the housing of the pump with slight play and pressed by a fluid pressure against the other gear and a sealing zone provided in the housing, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A gear pump comprising a pair of meshing gears, only one of which is provided with axial trunions; a housing having an inlet and an outlet and defining between said inlet and said outlet a chamber having inner peripheral cylindrical surface portions respectively engaging outer surfaces of the teeth of said gears, and opposite side faces in engagement with corresponding side faces of the gears; a pair of axially aligned bearing portions in said housing respectively receiving said trunions of said one gear for rotatably mounting said one gear, one of said trunions projecting beyond said housing for transmitting a torque to said one gear; a first sealing member arranged in said housing at the outlet thereof and subjected at one face thereof to fluid pressure in said outlet and engaging with an opposite face at least the other of said pair of gears for pressing the latter against a sealing zone provided at the inner peripheral surface of said chamber opposite said first sealing member and bordering said inlet; a single second sealing member located in a cavity of said housing; passage means for feeding fluid from said outlet onto an outer surface of said second sealing member for pressing an inner surface of the latter against said other gear and therewith said other gear against said one gear; a low pressure zone provided in an inner peripheral surface portion and extending about the other gear between said first and second sealing member; and a high pressure zone provided in said inner peripheral surface portion between said second sealing member and said sealing zone.

2. A gear pump as defined in claim 1, wherein said first and said second sealing member have each an inner arcuate surface of substantially the same radius as the outer radius of said other gear.

3. A gear pump as defined in claim 1, wherein said cavity in which said second sealing member is located is arranged substantially symmetrically to a plane including the axes of said two gears.

4. A gear pump as defined in claim 1, wherein said first sealing member engages also said one gear with an arcuate surface corresponding to the addendum circle of said one gear.

5. A gear pump as defined in claim 4, wherein said first sealing member extends with a portion thereof through said outlet and being provided in said portion with a passage therethrough having a cross-section smaller than that of said outlet.

6. A gear pump as defined in claim 1, wherein said low pressure zone and said high pressure zone are respectively formed by cavities in said inner peripheral surface portion of said housing, and including a first channel in said housing connecting the cavity of said low pressure zone with said inlet and a second channel in said housing connecting the cavity of said high pressure zone with said outlet.

7. A gear pump as defined in claim 6, wherein said cavities forming said low and said high pressure zones have each a width substantially equal to the thickness of said other gear.

8. A gear pump as defined in claim 6, wherein said cavity defining said low pressure zone extends from the cavity in which said second sealing member is arranged closely adjacent to the cavity in which said first sealing member is located.

9. A gear pump as defined in claim 6, wherein said cavity defining said high pressure zone extends from the cavity in which said second sealing member is arranged to said sealing zone.

* * * * *